US005878535A

United States Patent [19]

Green

[11] Patent Number: 5,878,535

[45] Date of Patent: Mar. 9, 1999

[54] SYSTEM FOR TEA SERVICE

[75] Inventor: Nancye Lewis Green, New York, N.Y.

[73] Assignee: Lipton, Division of Conopco, Inc., Englewood Cliffs, N.J.

[21] Appl. No.: 904,370

[22] Filed: Aug. 1, 1997

[51] Int. Cl.[6] ..... E04H 3/02

[52] U.S. Cl. ..... 52/33; 312/140.1; 312/235.2

[58] Field of Search ..... 52/33; 312/140.1, 312/235.2; 297/157.1; D25/58

[56] References Cited

U.S. PATENT DOCUMENTS

| | | | |
|---|---|---|---|
| 477,797 | 6/1892 | Fowler | 312/140.1 X |
| 1,463,633 | 7/1923 | Smith | 52/33 |
| 1,584,035 | 5/1926 | Knox | 312/140.1 |
| 2,289,861 | 7/1942 | Backus | 52/33 X |
| 3,350,151 | 10/1967 | Phillips | 312/235.2 X |
| 3,437,057 | 4/1969 | Wulff | 312/140.1 X |
| 4,259,816 | 4/1981 | Bergquist | 52/33 |

*Primary Examiner*—Christopher Kent
*Attorney, Agent, or Firm*—Milton L. Honig

[57] ABSTRACT

A system is provided for tea service in a modern style teahouse, the latter combining quick service with the ambiance of more traditional quiet seating. A transition area between the quick service public and quiet seating lounge areas holds an inner counter with tea and tea concentrate based product processing devices, an aisle allowing passage for a tea tender and a semi-circular service/information counter. The information counter includes a first and second horizontal countertop parallel to one another joined together by a vertical wall in a step arrangement. A plurality of stools are arranged around the information counter on a side opposite the aisle.

4 Claims, 3 Drawing Sheets

SYSTEM FOR TEA SERVICE

BACKGROUND OF THE INVENTION

1. Field of the Invention

The invention concerns a system for serving customers with tea-based products in the ambiance between fast food and high tea service.

2. The Related Art

Traditional teahouses are distinguished by their serene environment. Tea is consumed sip by sip, rather than gulp by gulp. The beverage is seen as a relaxing drink compared to coffee which often is used as a stimulant. Coffeehouses as distinguished from teahouses have the ambiance of hustle and bustle. Modern society is swift paced. Perhaps this is the reason that teahouses have never gained great popularity.

By contrast to coffee, tea, especially green tea is believed to have beneficial health effects. Promotion of this beverage is highly desirable yet has not become popular. The public needs to be further educated. Interest must be stimulated in the mystique of tea, as has recently occurred with coffee.

Accordingly it is an object of the present invention to provide a system for promoting and serving tea compatible with a quick service.

Another object of the present invention is to provide a system for promoting consumption of tea in a manner which educates the public regarding its health benefits and differences between tea varieties and different fast food formats incorporating the beverage.

Still another object of the present invention is to provide a system for promoting tea consumption which combines concepts of quick food service while retaining the serenity image of the beverage.

SUMMARY OF THE INVENTION

A system for serving tea products is provided including:

i) a semi-circular service and information counter, the counter including a first horizontal countertop, a second horizontal countertop and a vertical wall orthogonally joining the first and second countertops, the first and second countertops being parallel to one another;

ii) an aisle for allowing movement of a tea tender;

iii) an inner counter supporting tea concentrate based product processing devices, the inner counter being separated from the information counter by the aisle; and iv) a plurality of stools arranged around the information counter on a side opposite the aisle.

Advantageously the first and second countertops have approximately equal widths, usually about one foot each. The vertical wall may have a length approximately equal to the width of either first or second countertop. These dimensions are optimal for their respective functions. The second (lower) countertop serves the customer as a base for holding purchased product, the wall may support educational literature such as posters and the first (upper) countertop affords space to hold brochures and packaged for-sale products.

Location of posters on the vertical wall of the bar is ideal for transmitting information because the customer seated on the stool is at eye-level confronted with the poster. Viewtime becomes extended as the customer digests the tea beverage. Both information and related product are thereby simultaneously "processed" by the customer. Location of brochures on tea and tea products in close proximity to a seated, tea sipping customer further ensures that the appropriate educational material is being absorbed. Catalyst in this learning process about the beverage is the tea tender. In his or her strategic location along the aisle, the tender can further inform a customer regarding the nature of the tea products.

Tea tender and the system work in conjunction with one another, both to educate and deliver a product based upon that education. By the term "tea tender" is meant a customer servicing employee knowledgeable in tea, in its varieties and in the tea concentrate containing products available at the inner counter.

Typical of the educational effort may be information on differences, history and biology of traditional teas. Traditional teas include Darjeeling, Earl Grey, English Breakfast Blend, Irish Breakfast, Fine Assam, Keemun, Ceylon and Kenya Gold. Green teas can be described as including Jasmine, Dragonwell, Ti Kuan Yin and Sencha. Specialty teas include Gun Powder, Lapsong Souchong, Oolong, Silvery Tip Pekoe, Pu Erh, Gyokura and White Tea.

Among the products formulated with tea concentrate are hot chai-tea, chilled chai-tea, Fruit n' Tea, Frappe and Fruit n' Tea Spritzer. Chai is a combination of brewed tea, cardamom, cinnamon, fresh ginger, cloves, black pepper, vanilla and honey in the presence of milk or milk products.

BRIEF DESCRIPTION OF THE DRAWING

Further objects, advantages and features of the present invention will become more apparent from consideration of the drawing in which.

DETAILED DESCRIPTION OF THE INVENTION

Figure 1:
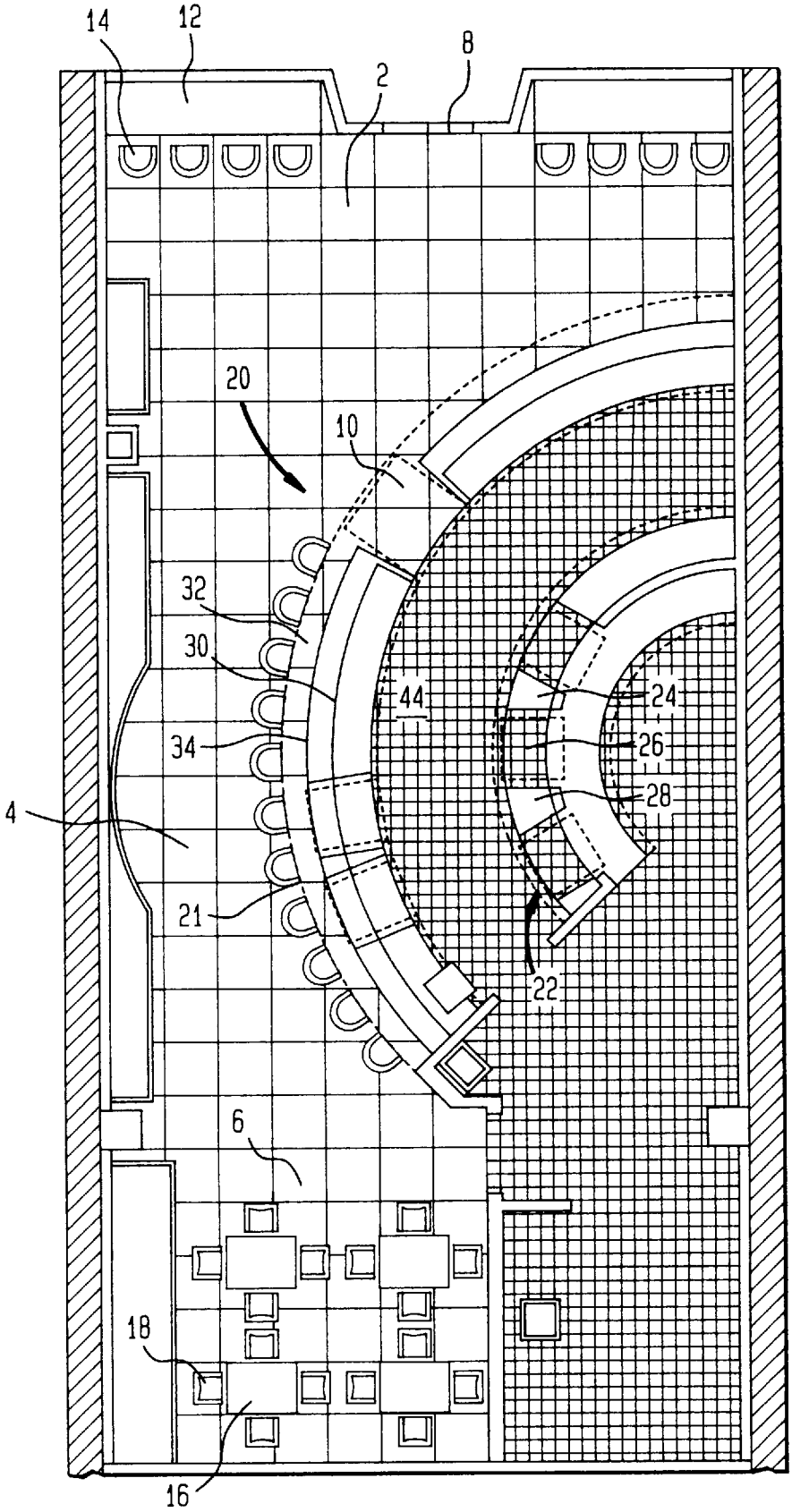
FIG. 1 is a top plan schematic view of the tea servicing areas according to the present invention.

According to the present invention there is provided a concept for a teahouse fitting modern lifestyles yet still providing a bridge to the relaxing serenity of traditional teahouse practice. FIG. 1 in schematic overview illustrates a modern teahouse layout according to this invention including a quick service public area 2, a service and information area 4, and a lounge area 6. Customers enter the teahouse through entrance 8 to first encounter public area 2. Quick orders for takeout beverages are filled at service counter 10. Customers then either leave the teahouse or have an opportunity to consume their purchase at a "fast food" type counter 12 complemented with stools 14.

Those customers seeking the ambiance of a traditional teahouse are serviced in the more secluded lounge area 6. Within the lounge area are a series of tables 16 with chairs 18.

Between public and lounge areas is located a combined customer service and tea product information area 4 with bar 20 functioning as a transition between modern and traditional teahouse practice. Bar 20 features an outer counter 21 and an inner counter 22. The inner counter 22 supports a variety of tea and tea-concentrate based product processing devices. These include quick brewing machines 24, blenders 26 and Granita type mixers 28. Outer counter 21 is structured with a first horizontal countertop 30 and a second horizontal countertop 32. Each of these are approximately one foot in width. These countertops are parallel to one another. A vertical wall 34 connects the first and second horizontal countertops. Tea informational posters 36 are affixed to vertical wall 34. Supported along the first countertop 30 may be further literature such as pamphlets and brochures 38. Both the posters and pamphlets/brochures carry tea educational/informational material including origins of the beverage, varieties available, history and other facts which enhance the pleasurable experience of drinking tea-based products. Also displayed along the first countertop 30 may be sale items such as loose teas 40. The second countertop 32 is utilized by the customer as a support surface on which to place purchased products 42 or those being taste tested in contemplation of purchase.

An aisle 44 separates the information/service counter 21 from inner counter 22. Along the aisle 44, a tea tender operates to both service and educate customers regarding teas.

Figure 2:
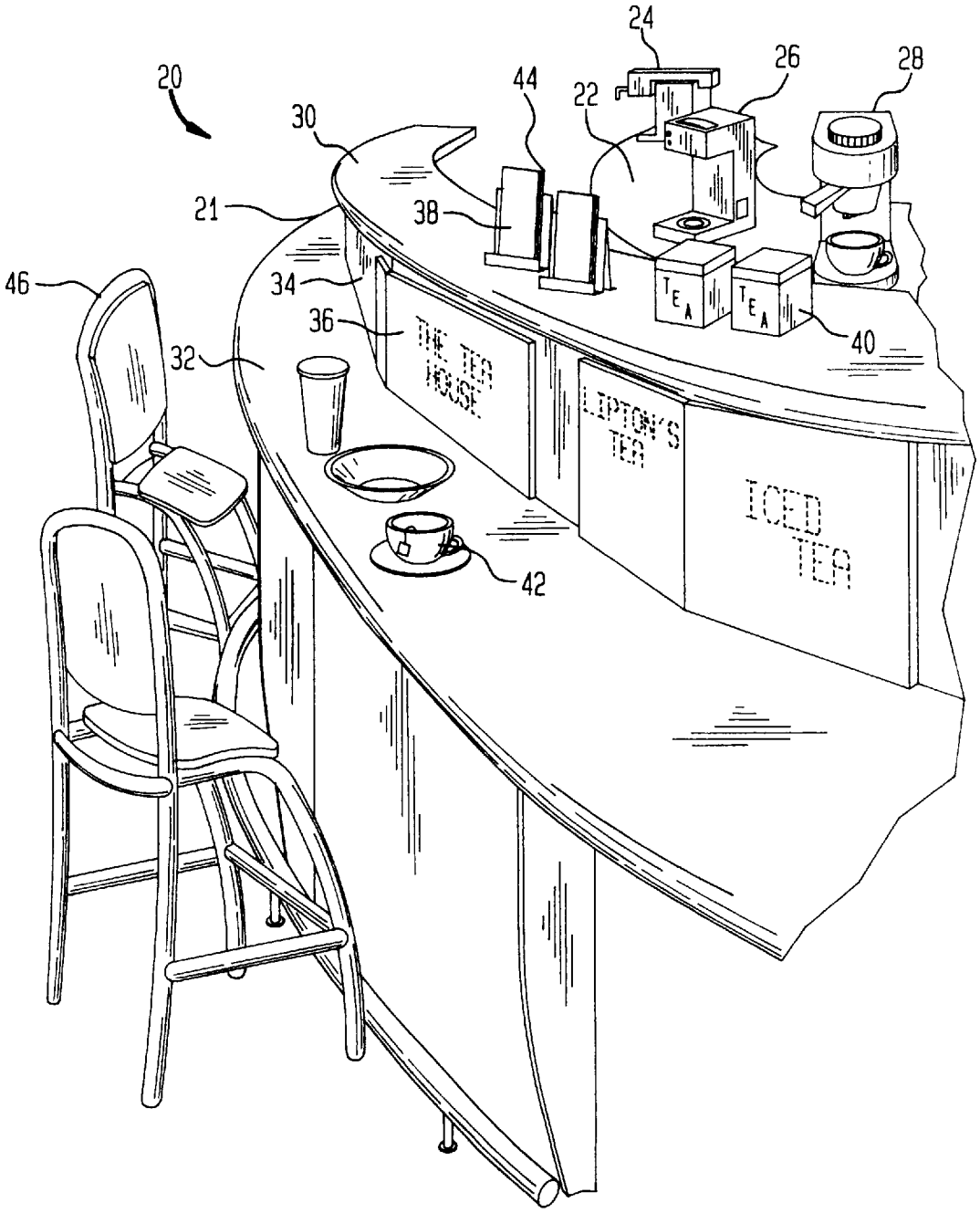
FIG. 2 is a front perspective view of the service and information bar flanked by the aisle and inner counter.

FIG. 2 illustrates in perspective the service and information counter 21 arranged in semi-circular form.

Figure 3:
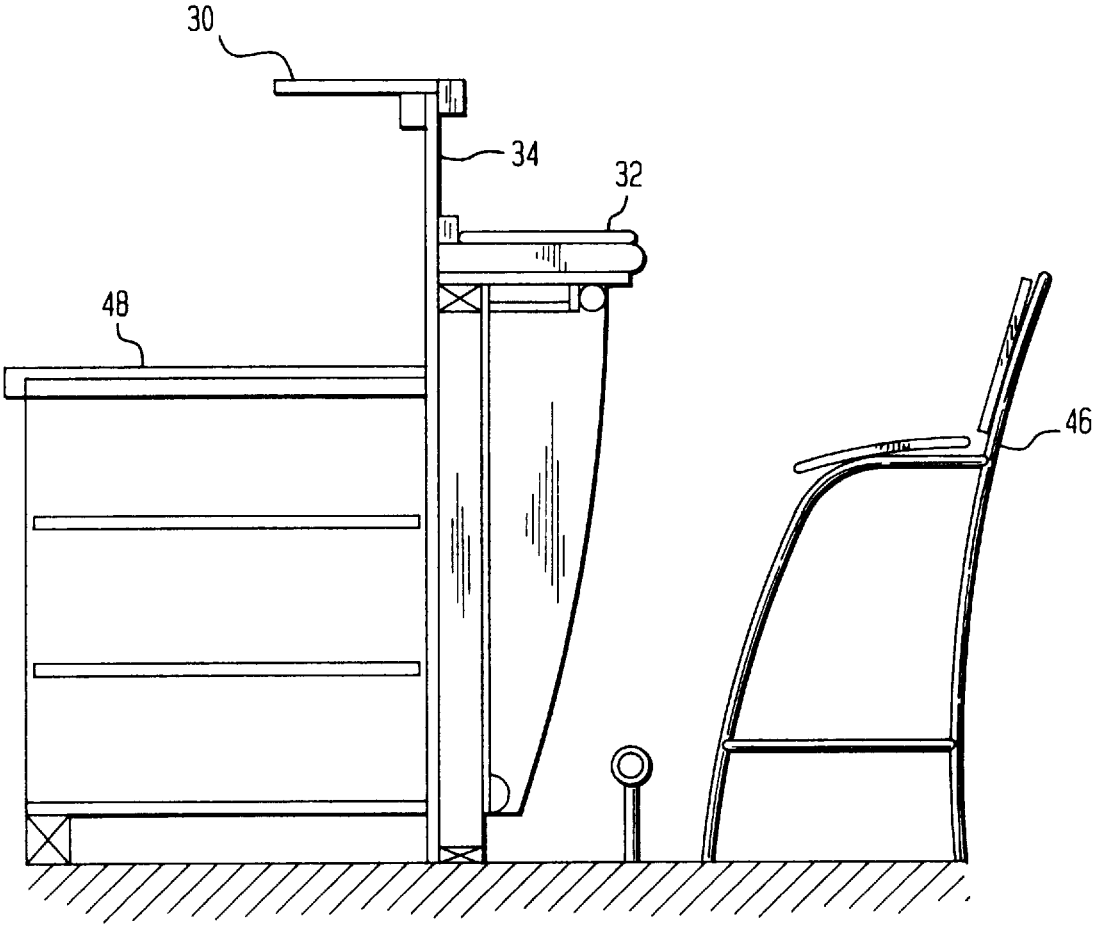
FIG. 3 is a cross-sectional view of the service and information bar including stool.

FIG. 3 best illustrates stools 46 which are arranged along the bar on a side opposite the aisle. Also illustrated in this figure are tea preparation surfaces 48 behind counter 21 on which a tea tender can prepare beverages for consumption.

Although only select embodiments of the present invention have been presented, those skilled in the art will be able to provide modifications all of which are within the purview and scope of the present invention.

What is claimed is:

1. A system for serving tea products comprising:

i) a semi-circular service and information counter, the counter including a first horizontal countertop, a second horizontal countertop and a vertical wall orthogonally joining the first and second countertops, at least one item of tea informational literature being affixed to the vertical wall, the first and second countertops being parallel to one another;

ii) an aisle for allowing movement of a tea tender;

iii) an inner counter supporting tea concentrate based product processing devices, the inner counter being separated from the information counter by the aisle; and iv) a plurality of stools arranged around the information counter on a side opposite the aisle.

2. The system according to claim 1 wherein the first and second countertops have approximately equal widths.

3. The system according to claim 2 wherein the vertical wall has a length approximately equal to the width of the first countertop.

4. The system according to claim 1 further comprising tea informational brochures placed on the first horizontal countertop.

* * * * *